US007185639B1

(12) United States Patent
Roche et al.

(10) Patent No.: US 7,185,639 B1
(45) Date of Patent: Mar. 6, 2007

(54) EVAPORATIVE EMISSION CONTROLS

(75) Inventors: Ronald H. Roche, Cass City, MI (US); John C. Woody, Caro, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 175 days.

(21) Appl. No.: 10/955,795

(22) Filed: Sep. 30, 2004

(51) Int. Cl.
*F02M 37/20* (2006.01)
*F02D 77/08* (2006.01)

(52) U.S. Cl. ..... 123/516; 123/198 DB

(58) Field of Classification Search ..... 123/457, 123/458, 467, 497, 510, 511, 198 D, 198 DB, 123/516, 518, 519
See application file for complete search history.

(56) References Cited

U.S. PATENT DOCUMENTS

| | | | | |
|---|---|---|---|---|
| 2,009,109 | A | 7/1935 | Hunt | |
| 3,601,107 | A | 8/1971 | Rohrbacher | |
| 3,618,581 | A | 11/1971 | Simonet | |
| 3,935,850 | A * | 2/1976 | King | 123/520 |
| 3,957,025 | A * | 5/1976 | Heath et al. | 123/518 |
| 4,016,848 | A * | 4/1977 | Nagai | 123/519 |
| 4,035,994 | A | 7/1977 | Hoff | |
| 4,077,381 | A | 3/1978 | Firey | |
| 4,083,344 | A * | 4/1978 | Sakurai et al. | 123/520 |
| 4,085,721 | A * | 4/1978 | Vardi et al. | 123/520 |
| 4,086,897 | A * | 5/1978 | Tamura et al. | 123/520 |
| 4,111,176 | A | 9/1978 | Fenton et al. | |
| 4,127,097 | A * | 11/1978 | Takimoto | 123/520 |
| 4,149,504 | A * | 4/1979 | Walters | 123/520 |
| 4,153,025 | A * | 5/1979 | Thornburgh | 123/520 |
| 4,212,276 | A * | 7/1980 | Kaneda | 123/519 |
| 4,254,064 | A | 3/1981 | Bernauer et al. | |
| 4,277,424 | A | 7/1981 | Shivers, Jr. | |
| 4,280,466 | A * | 7/1981 | Walters | 123/520 |
| 4,456,216 | A * | 6/1984 | Boruta | 251/11 |
| 4,520,772 | A | 6/1985 | Scott et al. | |
| 4,730,592 | A * | 3/1988 | Uozumi et al. | 123/516 |
| 4,741,317 | A * | 5/1988 | Yost | 123/520 |
| 5,092,295 | A | 3/1992 | Kobayashi | |
| 5,148,793 | A * | 9/1992 | Reddy | 123/520 |
| 5,579,802 | A | 12/1996 | Tuckey | |
| 5,592,963 | A | 1/1997 | Bucci et al. | |
| 5,682,845 | A | 11/1997 | Woody | |

(Continued)

OTHER PUBLICATIONS

Brochure of Walbro Engine Management LLC, "The Regulator", vol. 1, Issue 1, Handheld and Lawn & Garden, Fall 2002, 9 pgs.

*Primary Examiner*—Thomas Moulis
(74) *Attorney, Agent, or Firm*—Reising, Ethington, Barnes, Kisselle, P.C.

(57) ABSTRACT

A method, fuel system, and a valve for facilitating the delivery of liquid fuel and fuel vapors from a fuel tank in fluid communication with a carburetor of an internal combustion engine. During operation of the internal combustion engine, the fuel tank is permitted to fluidically communicate the liquid fuel to the carburetor, and to vent the fuel vapors to one or more of a carbon canister, the atmosphere, and the carburetor. In contrast, when the internal combustion engine is not operating, the fuel tank is prevented from fluidically communicating the liquid fuel to the carburetor, and from venting the fuel vapors to one or more of the carbon canister, the atmosphere, and the carburetor, thereby preventing escape of evaporative emissions of the fuel from the fuel tank.

41 Claims, 5 Drawing Sheets

U.S. PATENT DOCUMENTS

| | | | | |
|---|---|---|---|---|
| 5,906,189 | A | 5/1999 | Mukai et al. | |
| 6,082,323 | A | 7/2000 | Winberg | |
| 6,213,083 | B1 | 4/2001 | Winberg | |
| 6,401,685 | B1 | 6/2002 | Warner | |
| 6,402,124 | B1 | 6/2002 | Pattullo et al. | |
| 6,450,152 | B1 | 9/2002 | Everigham | |
| 6,499,472 | B2 | 12/2002 | Weldon et al. | |
| 6,523,809 | B2 | 2/2003 | Woody | |
| 6,553,975 | B2 | 4/2003 | Weldon et al. | |
| 6,561,495 | B2 | 5/2003 | Woody | |
| 6,601,569 | B2 | 8/2003 | Weldon et al. | |
| 6,615,792 | B1 | 9/2003 | Grifka et al. | |
| 6,640,770 | B2 | 11/2003 | Woody | |
| 6,668,807 | B2 | 12/2003 | Weldon et al. | |
| 6,691,683 | B2 | 2/2004 | Gracyalny et al. | |
| 6,786,227 | B2 * | 9/2004 | Weldon et al. | 137/14 |
| 7,051,692 | B1 * | 5/2006 | Powers | 123/179.15 |
| 2003/0066505 | A1 * | 4/2003 | Woody | 123/198 D |
| 2003/0173365 | A1 | 9/2003 | Stickel | |
| 2006/0048752 | A1 * | 3/2006 | Stroia et al. | 123/458 |

* cited by examiner

EVAPORATIVE EMISSION CONTROLS

CROSS-REFERENCES TO RELATED APPLICATIONS

The present invention is related to pending U.S. patent application of Ronald H. Roche et al, Ser. No. 10/955,133, filed Sep. 30, 2004, entitled "EVAPORATIVE EMISSION CONTROLS IN A FUEL SYSTEM", and to pending U.S. patent application of Ronald H. Roche et al, Ser. No. 10/955,781, filed Sep. 30, 2004, entitled "CONTROLLING EVAPORATIVE EMISSIONS IN A FUEL SYSTEM". Each of the above-listed cross-referenced patent applications is assigned to the assignee hereof and is incorporated herein by reference.

FIELD OF THE INVENTION

This invention relates generally to volatile fuel storage and delivery systems for internal combustion engines, and more particularly to evaporative emission controls adapted for use with a carburetor.

BACKGROUND OF THE INVENTION

A fuel storage and delivery system typically includes a fuel tank and a carburetor that are adapted for use in small, internal combustion engine-powered apparatuses. These apparatuses comprise a large consumer market of popular lawn and garden products, which include hand-held equipment such as hedge trimmers, grass trimmers, and chainsaws and further include ground-supported equipment such as garden tractors, rototillers, and lawnmowers. In recent years, such products have been improved to reduce engine exhaust emissions, but now emphasis is being placed on improving these products to reduce non-exhaust emissions of volatile fuels such as gasoline.

Volatile fuel emissions generally include hot soak losses, running losses, and diurnal losses. Diurnal losses result from emission of liquid or vaporous fuel and include permeation losses and evaporative losses. Permeation losses occur when fuel vapor permeates through gaskets, fuel lines, or the fuel tank, and such losses are often abated by materials-oriented solutions such as integrating vapor barrier layers within fuel lines and fuel tanks. Evaporative losses occur when liquid fuel evaporates into hydrocarbon vapor and escapes into the atmosphere. Evaporation of liquid fuel into fuel vapor is usually due to volatility of the fuel, vibration of the fuel tank and sloshing of the fuel therein, and temperature fluctuations of the fuel. Evaporative losses most often occur 1) when fuel vapors in a fuel tank are vented to the atmosphere, and 2) when fuel vapors in a carburetor are vented or otherwise escape to the atmosphere.

Fuel vapors are often vented from a fuel tank to the atmosphere to avoid build-up of positive pressure in the fuel tank. Hand-held equipment use diaphragm carburetors, which have spring-biased inlet valves that provide automatic shutoff against such positive tank pressures and, thus, do not require outward venting of the fuel tank. But ground-supported equipment use float-bowl carburetors, which become flooded under such positive tank pressures. When an engine of a piece of ground-supported equipment is operating, fuel flows out of the fuel tank, and the tank vent allows make-up air to enter the tank to replace the fuel and thereby prevent a negative pressure condition therein. When the engine is not operating, however, fuel vapors may be permitted to vent out to the atmosphere from within the fuel tank to limit tank pressure and avoid carburetor flooding.

Fuel tank vapors are typically recovered using a fuel vapor recovery system. Such systems may include a carbon canister having activated charcoal therein that receives fuel vapors through a valve assembly mounted on the fuel tank and that communicates with an intake manifold of the engine. During engine operation, negative pressure in the intake manifold draws fuel vapor out of the carbon canister. The valve assembly usually has a valve that is responsive to the level of liquid fuel in the fuel tank that enables the valve to stay open at a sufficiently low liquid level to permit fuel vapors to flow freely from the tank into the carbon canister. When filling the tank, as the liquid fuel level rises to approach a desired maximum level of fuel, a float is raised to close the valve to prevent liquid fuel from flowing through the valve and into the vapor-receiving canister. While such a system works well, the added cost of the carbon canister and float valve is prohibitive in many applications.

In addition to fuel tank vapor emissions, fuel vapors also tend to escape from a carburetor, particularly when the associated equipment is hot and/or stored for an extended period of time. To illustrate, when a piece of engine-powered equipment is shut down after running at normal operating temperatures, heat continues to transfer from a hot cylinder head of the engine through an intake manifold to the carburetor. Moreover, the equipment may be placed in a storage enclosure with limited or no ventilation, wherein the temperature may fluctuate over a twenty-four hour period from a daytime high exceeding 160 degrees Fahrenheit to a nighttime low of 60 degrees Fahrenheit. Gasoline fuel evaporates over a wide temperature range starting at around 90 degrees Fahrenheit, with approximately thirty percent by volume evaporating over a temperature increase to 160 degrees Fahrenheit over a 24 hour period, and with about ninety plus percent by volume evaporating over an increase to 350 degrees Fahrenheit over a 24 hour period. In any case, the temperature of the liquid fuel within the carburetor increases dramatically, thereby vaporizing some of the liquid fuel into fuel vapor.

Fuel escapes from some carburetors more readily than others. Hand-held equipment typically includes two-stroke engines having diaphragm carburetors, which tend to yield relatively low evaporative emissions. Unfortunately, however, diaphragm carburetors are not practical for all engine applications because they tend to have limited fuel metering capabilities, thereby leading to operational instability with certain types of engines. Precision fuel metering is generally not required in engines equipped with diaphragm carburetors, because such engines are usually operated in only two fixed throttle settings—idle or wide-open-throttle (WOT)—such as in chainsaw or grass trimmer applications. In contrast, ground-supported equipment typically have engines with float-bowl carburetors that usually have relatively higher fuel metering capabilities to accommodate infinitely variable throttle settings between idle and WOT, but tend to yield relatively higher evaporative emissions for several reasons.

First, the volume of fuel contained in a float bowl of a given float bowl carburetor is usually several times greater than that contained in a chamber of a diaphragm carburetor. Commensurately, the total volume of liquid fuel that may be depleted from a float bowl carburetor will be several times greater than that from a diaphragm carburetor.

Second, diaphragm carburetors are not continuously supplied with fuel from the fuel tank when the engine is not operating. In this case, fuel may completely evaporate from within the diaphragm carburetor, but is not continuously replenished with fuel from the fuel tank. This is because a typical diaphragm carburetor has an inlet needle valve that is strongly biased closed to prevent entry of such fuel. The typical float bowl carburetor, however, is continuously supplied with additional liquid fuel from which additional evaporation takes place. This is because a typical float-bowl carburetor has an inlet needle valve that is normally biased open unless the float bowl is filled with fuel to a predetermined level, at which point a float gently raises the inlet needle valve to a closed position. As the liquid fuel vaporizes and escapes from the carburetor float bowl, the float and inlet needle valve drop thereby allowing fresh liquid fuel to enter the float bowl through the float-actuated inlet needle valve under gravity feed from the fuel tank. Hence, diurnal losses in a float bowl carburetor are increased due to these vaporization-replenishment-vaporization cycles.

Third, as indicated above, float-bowl carburetors are more sensitive to fuel inlet pressure than diaphragm carburetors. Consequently, the fuel tank must have as low and constant an internal pressure as possible, yet still support a high enough threshold pressure to minimize fuel vapor loss to the atmosphere. Unfortunately, conventional combination rubber duck bill and umbrella valves, typically associated with diaphragm carburetor fuel systems, tend to suffer from hysteresis. Thus, such valves are not capable of repeatably holding a tank pressure close enough to a predetermined threshold pressure.

In conclusion, equipment manufacturers are in need of a wide range of reliable and comprehensive technological solutions to the problem of diurnal evaporative emissions of volatile fuel from a fuel system—particularly those solutions that address all of the escape routes of vapor emissions and that are robust and affordable to consumers.

SUMMARY OF THE INVENTION

A method and a fuel system for delivering fuel from a fuel tank in fluid communication with a carburetor of an internal combustion engine. Fuel is contained within the fuel tank, wherein the fuel includes liquid fuel and fuel vapors. During operation of the internal combustion engine, the fuel tank is permitted to fluidically communicate the liquid fuel to the carburetor, and to vent the fuel vapors to one or more of a carbon canister, the atmosphere, and the carburetor. In contrast, when the internal combustion engine is not operating, the fuel tank is prevented from fluidically communicating the liquid fuel to the carburetor, and from venting the fuel vapors, thereby preventing escape of evaporative emissions of the fuel from the fuel tank. According to another aspect of the present invention there is also provided a valve for controlling fluid flow that includes a valve body having at least three fluid passages formed therein, and a valve head carried by the valve body for movement between at least first and second positions and having at least two connecting passages formed therein, each connecting passage being selectively registered with at least two fluid passages to permit fluid communication between the at least two fluid passages through the connecting passage.

In one presently preferred embodiment of the valve, the connecting passages are preferably defined at least in part by grooves formed in an end face of the valve head. The grooves are rotated into and out of alignment with two or more passages in the valve body as the valve head is moved between its first and second positions to selectively permit fluid communication between two or more of the fluid passages. The valve is readily adaptable to a wide variety of applications and fluid routing and control schemes. In one scheme the valve may be used to control the venting of fuel vapors from a fuel tank and a carburetor in a fuel system for a combustion engine.

At least some of the objects, features and advantages that may be achieved by at least certain embodiments of the invention include providing a method, fuel system, and valve that enable a reduction in the emission to the atmosphere of unburned fuel vapors, improve control of fluid flow in a fuel system, can be actuated in a variety of ways including at least manual and powered or automatic, are readily adaptable to a wide range of applications, are of relatively simple design and economical manufacture and assembly, are durable, reliable and have a long useful life in service.

Of course, other objects, features and advantages will be apparent in view of this disclosure to those skilled in the art. Other fuel systems embodying the invention may achieve more or less than the noted objects, features or advantages.

BRIEF DESCRIPTION OF THE DRAWINGS

These and other objects, features and advantages of the present invention will be apparent from the following detailed description of the preferred embodiments and best mode, appended claims and accompanying drawings in which:

DETAILED DESCRIPTION OF THE PREFERRED EMBODIMENTS

Figure 1:
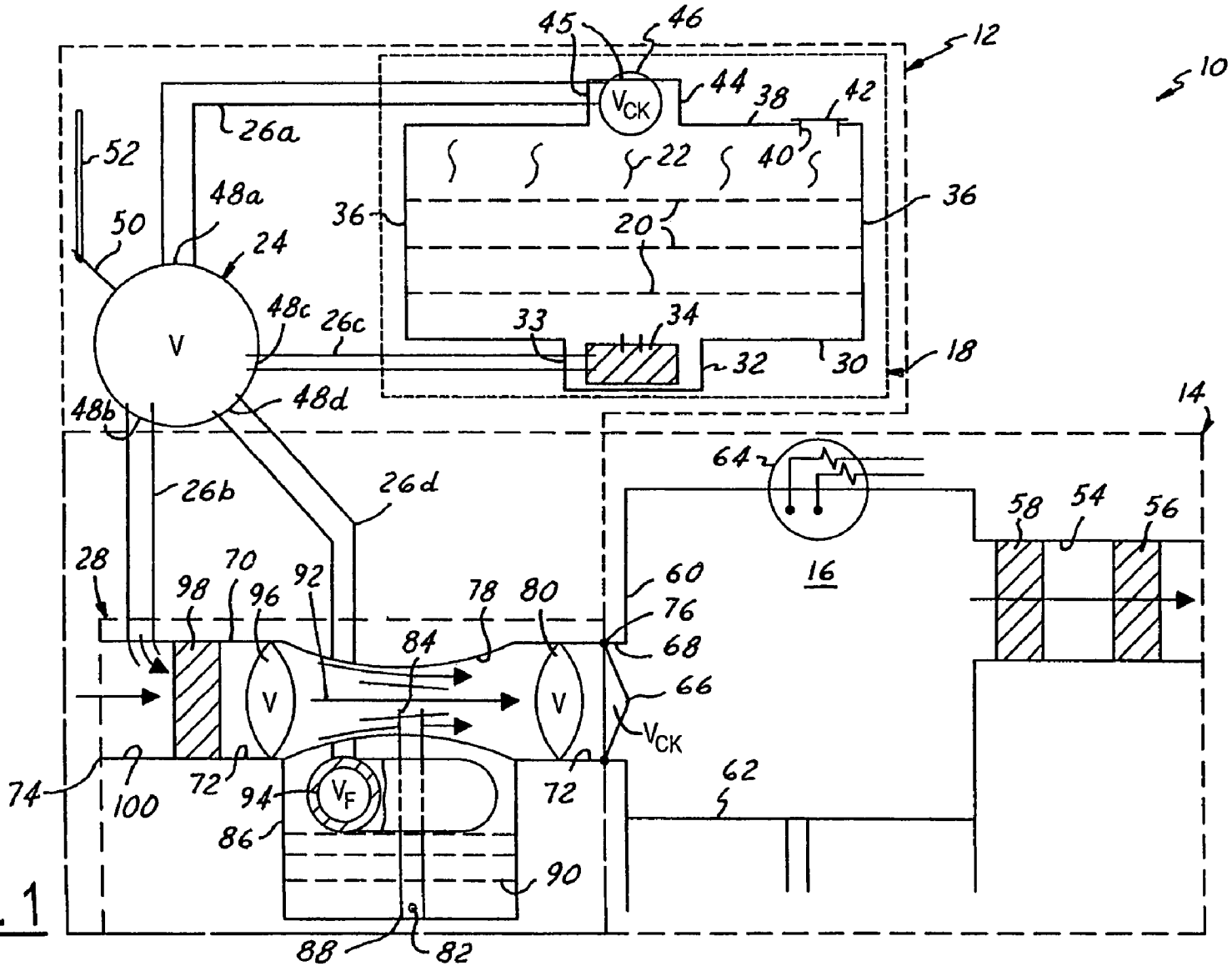
FIG. 1 is a diagrammatic view of an engine-powered apparatus having a fuel system according to one presently preferred embodiment of the present invention.

Referring now in detail to the drawings, FIG. 1 illustrates a diagrammatic view of a portion of a ground-supported engine-powered apparatus 10 such as a garden tractor, rototiller, pressure washer, generator, lawnmower, or the like. More specifically, FIG. 1 depicts a fuel system 12 for storing fuel and delivering the fuel to an internal combustion engine 14 for combustion within a combustion chamber 16 thereof. The fuel system 12 includes a fuel tank 18 for containing fuel therein that includes a portion of liquid fuel 20 and a portion of fuel vapors 22. The liquid fuel 20 is substantially composed of a volatile combustible liquid but may include some impurities as is typical with fuel. Similarly, the fuel vapors 22 are substantially composed of combustible fuel vapors but may also be mixed with impurities or may be diluted with a supply of atmospheric or fresh air. The fuel tank 18 is in fluid communication with a multi-passage valve 24, wherein the valve 24 regulates fluid communication from the fuel tank 18 to a carburetor 28 of the internal combustion engine 14 via conduits or fuel lines 26*a*, 26*b*, 26*c*, 26*d* (hereinafter 26*a*–*d*).

The fuel tank 18 includes a bottom wall 30 with a liquid reservoir 32 therein for housing a fuel filter 34 in fluid communication with a liquid fuel outlet 33 of the fuel tank 18. The fuel tank 18 further includes a sidewall 36 extending from the bottom wall 30, and a top wall 38 terminating the sidewall 36 and having a fuel inlet or filler spout 40 sealed by an unvented cap or closure 42 and further having a vapor dome or reservoir 44 that is disposed at a high point of the fuel tank 18 for housing a vapor vent valve 46 in a fuel vapor outlet 45 therein. As defined herein, the term vent broadly means any outward or inward flow of fluid from one area to another. The tank 18 and closure 42 may be composed of any suitable materials including steel and a multi-layer plastic composition having a vapor barrier layer. As one example without limitation, the tank 18 and closure 42 may be composed of plastic material having an ethylene vinyl alcohol barrier layer that is sandwiched between high density polyethylene structural layers. Similarly, the fuel lines 26*a*–26*d* may be composed of multiple layers and by way of example, may be three layer non-conductive fuel lines such as Permblok® 330 hoses. The fuel filter 34 may be any one of a multitude of conventional fuel tank filters, which are well known in the art. The vapor vent valve 46 may be a multiple function valve such as an atmospheric inlet/vapor outlet valve. One preferred type of the valve 46 is depicted in FIG. 2.

Figure 2:
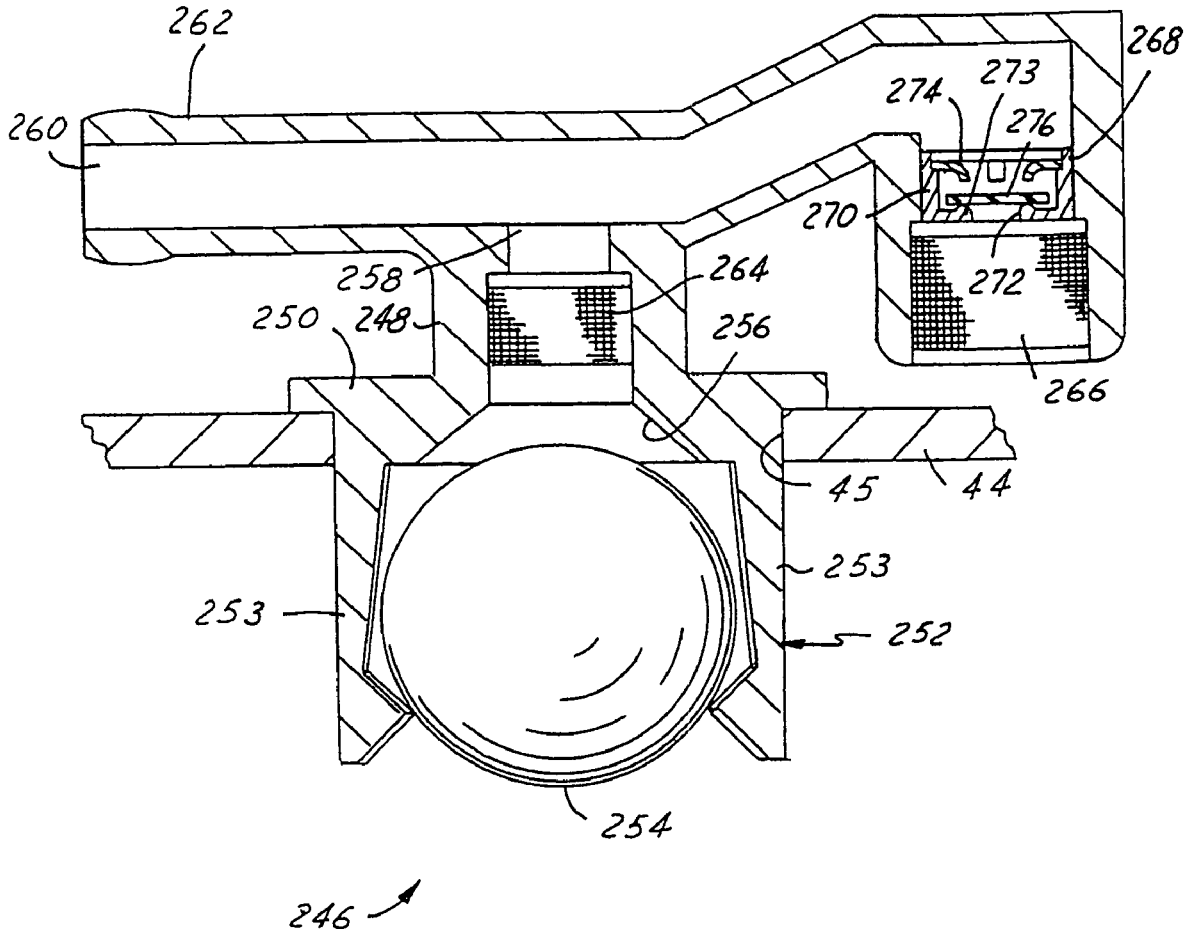
FIG. 2 is a cross-sectional view of a portion of the fuel system of FIG. 1, illustrating a vapor vent valve according to another presently preferred embodiment of the present invention.

FIG. 2 illustrates a preferred, exemplary vapor vent valve 246 that may be mounted to the vapor reservoir 44 portion of the fuel tank 18, or that may be mounted to any other suitable portion of the fuel tank 18 that would permit vapors to be communicated out of the tank through the valve 246. The present invention contemplates that suitable seals (not shown) could be interposed between the vapor vent valve 246 and the fuel tank 18 to prevent escape of hydrocarbon vapors from within the fuel tank 18. Nonetheless, the vapor vent valve 246 includes a body 248 that terminates in a mounting flange 250 from which extends a cage 252 for retaining a hollow float valve or ball 254 that substantially prevents liquid fuel from exiting the tank 18 through the vapor vent valve 246. As the liquid level in the tank 18 rises, or as liquid is splashed or sloshed into the vapor reservoir 44, the float ball 254 rises and seats against a spherical valve seat 256 to close off the valve 246.

A main passage 258 is disposed downstream of the valve seat 256 and communicates with an outlet passage 260 within a nipple 262 of the valve 246. Within the main passage 258 of the body 248 there is disposed an outlet filter 264 and an inlet filter 266 for preventing dirt and other contaminants from entering from the atmosphere or from exiting the fuel tank 18 and entering the valve 24. Also within an inverted branch of the main passage 258, there is disposed a check valve 268 that permits entry of atmospheric air into the fuel system 12, particularly into the tank 18 but does not allow fuel vapor to flow therethrough to the atmosphere. During operation of the apparatus of FIG. 1, the engine 14 consumes liquid fuel from the fuel tank 18, thereby tending to create a vacuum or negative pressure condition within the tank 18. The check valve 268, however, permits replacement or make-up air to enter through the filter 266, check valve 268, outlet filter 264, and past the float ball 254 (when it is spaced from the valve seat 256) into the tank 18. Without the make-up air flowing through the check valve 268 to alleviate any negative pressure conditions within the tank 18, the engine 14 would otherwise begin to run "lean" on liquid fuel and eventually become starved of liquid fuel and cease operation.

Structurally, the check valve 268 includes an annular body 270 defining a passage 272 and a valve seat 273, a segmented valve retainer 274 attached to an opposite end of the body 270, and a flat circular valve head or member 276 therebetween that is seated under the force of gravity. Positive pressure within the fuel tank 18, such as that caused by evaporation of fuel, leads to superatmospheric pressure in the main passage 258 of the valve 246 that holds the valve member 276 of the check valve 268 against the valve seat 273. Under such conditions, the valve member 276 thereby prevents flow through the check valve 268. Also the check valve 268 is disposed in an inverted branch, or "U" portion, of the main passage 258 such that the valve member 276 sits closed on the valve seat 273 due to gravity. Negative pressure within the fuel tank 18, such as that caused by liquid fuel flow therefrom, yields subatmospheric pressure in the main passage 258 of the valve 246. As pressure in the main passage 258 becomes subatmospheric, the valve member 276 is displaced from the valve seat 273 and air flows into the main passage 258 through the check valve 268. The pressure differentials needed to open and close the valve member 276 can be controlled by selecting the weight of the valve member 276 and the area of the surfaces on which the pressures act, wherein atmospheric pressure acts on one side and tank pressure acts on the opposite side. Fuel vapor and other gaseous fluids exit the tank 18 through the vapor vent valve 246 with the vapor passing between circumferential spaced apart fingers 253 that define part of the cage 252, between the float ball 254 and seat 256, through the filter 264 and passage 258, and thus out of the outlet passage 260.

Referring again to FIG. 1, vapors flow out of the fuel tank 18 through the vapor vent valve 46 and vapor line 26*a* and into the valve 24. The vapor conduit or line 26*a* has an upstream end in fluid communication with the vapor vent valve 46 and an oppositely disposed downstream end. Liquid fuel flows out of the fuel filter 34 through fuel line 26*c* and into the valve 24. The liquid conduit or fuel line 26*c* has an upstream end in fluid communication with the liquid fuel outlet 33 of the fuel tank 18 and an oppositely disposed downstream end. The valve 24 is preferably a multiple passage shutoff valve having a plurality of inlets 48*a*, 48*c* and outlets 48*b*, 48*d* for regulating flow of vapor and liquid components of the fuel in the fuel tank 18 to the carburetor 28. The valve 24 includes an actuation lever 50 that is attached to and driven by one end of a push-pull cable 52, such as a Bowden cable, that is attached at an opposite end (not shown) to an engine shutdown mechanism such as an ignition control device, operator safety bail lever, safety tether, other safety device, or the like (none shown) at a suitable location on the engine-powered apparatus 10. Alternatively, it is contemplated that the valve 24 could be actuated with a solenoid (not shown) on any engine-powered apparatus having a power source to drive the solenoid. The present invention further contemplates any other type of manual or automatic actuation including vacuum actuation, and the like. The vapor inlet 48*a* is selectively communicated with the vapor outlet 48*b*, and the liquid inlet 48*c* is selectively communicated with the liquid outlet 48*d* as the valve 24 is moved between at least first and second positions. The detailed function and structure of the valve 24 will be described after a description of the internal combustion engine 14 to which the valve 24 is fluidically connected.

Still referring to FIG. 1, the internal combustion engine 14 may be a conventional two-cycle, four-cycle, or rotary engine with the exception of the particular details described herein. Starting at a downstream end, the engine 14 includes an exhaust passage 54 having a muffler 56 and possibly, but not necessarily, a catalytic element 58 disposed therein, as is typically known in the art. The exhaust passage 54 exhausts gases from the combustion chamber 16 of the engine 14 that is defined by a cylinder 60 and a piston 62. It is contemplated that the present invention is also adaptable for use with multi-cylinder engines. In any event, the exhaust gases are produced by a combustion process initiated by a spark plug 64 and fueled by an air/fuel mixture supplied by the carburetor 28 through an engine air intake valve arrangement 66 disposed in an intake passage 68 of the engine 14.

The carburetor 28 is preferably a low evaporative emission float-bowl carburetor that is exemplified by U.S. Pat. No. 6,561,495 or by U.S. Pat. No. 6,640,770, both of which are assigned to the assignee hereof and incorporated by reference in their entireties herein for exemplary purposes. The carburetor 28 includes a body 70 with an air/fuel mixing passage 72 extending therethrough from an inlet end 74 to an outlet end 76 in communication with the intake passage 68 of the engine 14 and having a venturi section 78 therebetween. Adjacent the outlet end, a butterfly-style throttle valve 80 is disposed within the mixing passage 72 for regulating the quantity of mixed fuel and air that proceeds downstream to the combustion chamber 16 of the engine 14. Upstream of the throttle valve 80, there may be included a venturi section 78 of the mixing passage 72 and in fluid communication with a main nozzle 84 depending from the body 70 of the carburetor 28 and having an inlet end 88 terminating inside of a float bowl 86 that is attached to the body 70 of the carburetor 28. The float bowl 86 contains a substantially constant supply of carburetor fuel 90, which, under a venturi pressure drop through the venturi section 78 of the mixing passage 72, is drawn into a jet 82 upward through the main nozzle 84 and into the venturi 78 to be mixed with incoming air 92. A float valve 94 is typically disposed within the float bowl 86, typically surrounding the main nozzle 84, for regulating the quantity of incoming liquid fuel based on a predetermined desired or designed level of fuel 90 in the float bowl 86. The liquid conduit or line 26*d* has an upstream end in fluid communication with the liquid outlet 48*d* of the valve 24 and a downstream end in fluid communication with the float valve 94 and hence the float bowl 86 of the carburetor 28.

Just upstream of the venturi section 78, there preferably is disposed a butterfly-style choke valve 96 for regulating the quantity of air that proceeds downstream to the venturi section 78 during starting and warm-up of the engine. Further upstream, there preferably is disposed an air filter 98 for filtering incoming air to prevent dirt and other contaminants from entering the rest of the engine. A noise suppression chamber 100 is defined between the air filter 98 and the opening of the inlet end 74 of the carburetor mixing passage 72. The noise suppression chamber 100 communicates with one end of the vapor line 26*b* that supplies fuel vapor to the carburetor 28 from the valve 24. The vapor conduit or line 26*b* has an upstream end in fluid communication with the vapor outlet 48*b* of the valve 24, and a downstream end in fluid communication with the carburetor mixing passage 72, as shown. Alternatively, however, the downstream end of the vapor line 26*b* may be in fluid communication with a carbon canister (not shown), the atmosphere, an intake of the engine, an engine air cleaner, and the like. The location for the induction of the fuel tank vapors in the carburetor mixing passage 72 is predetermined such that there is not a substantial vacuum induced on the fuel tank 18 through the open vapor vent passage 26*a* to avoid impeding the flow of liquid fuel to the carburetor 28. If a substantial vacuum were to be applied to the open vapor vent passage 26*a*, such as if the vapor line 26*b* was communicated to the venturi 78 instead of upstream thereof, then a negative pressure condition would tend to be induced within the fuel tank 18 above the surface of the liquid fuel 20. This negative pressure condition would tend to work against the natural flow of the liquid fuel 20 under gravity to the carburetor 28, thereby causing the carburetor 28 to starve or run undesirably lean. Therefore, it is preferred to communicate the noise suppression chamber 100, via the vapor vent line 26*b*, with the valve 24.

The valve 24 of FIG. 1 may be as described with reference to a preferred embodiment of the valve 24 according to FIGS. 3–9, by way of example only and without limitation. FIGS. 3–7 illustrate a preferred valve 310 that selectively permits and prevents fluid flow through and between a plurality of fluid passages, and/or controls fluid flow through a plurality of fluid passages. The valve 310 may be used in a fuel system, such as that described above. Desirably, the valve 310 may be used to control venting of fuel vapors and liquid fuel from the fuel tank 18 of the fuel system 12 of FIG. 1, by way of an example without limitation.

Figure 3:
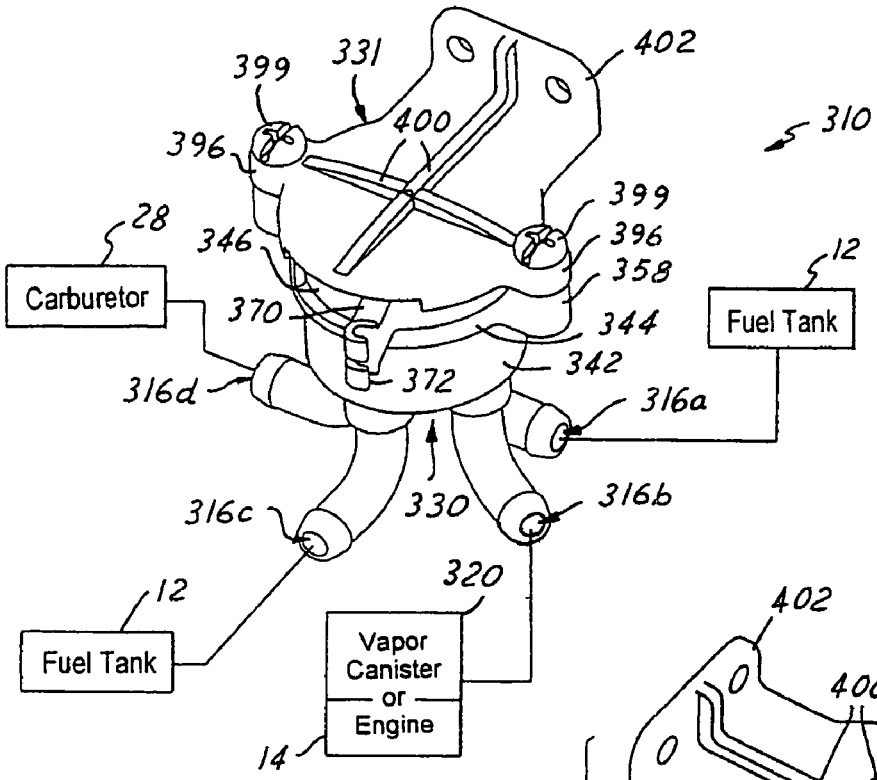
FIG. 3 is a perspective view of a valve according to a further presently preferred embodiment of the present invention.
Figure 6:
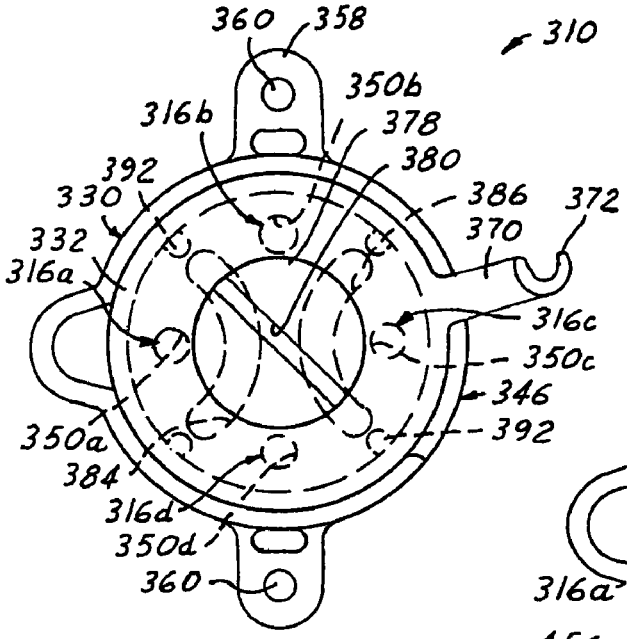
FIG. 6 is a somewhat diagrammatic plan view of the valve of FIG. 3 with some components removed to illustrate the relative position of one or more connecting passages with one or more openings in the valve body when a valve head is in its first position.
Figure 7:
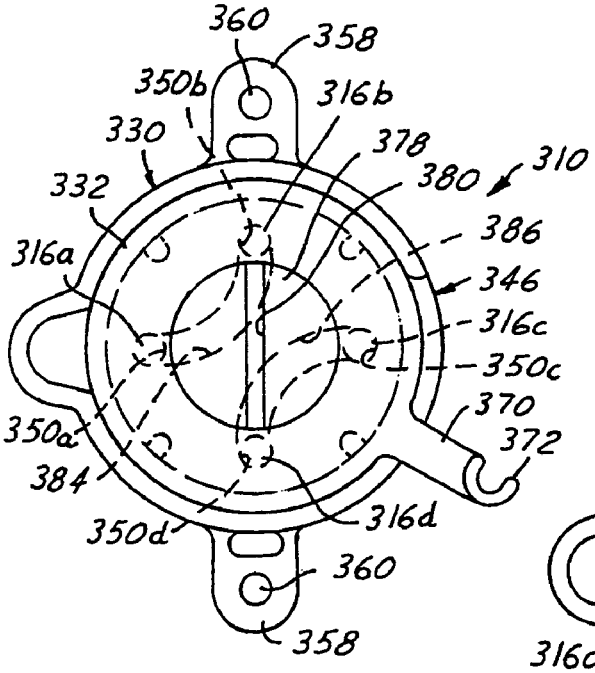
FIG. 7 is a view similar to FIG. 6 illustrating the valve head in its second position.

Also by way of example and as shown in FIGS. 3, 6 and 7, the valve 310 may define at least part of a first fluid passage 316*a* that communicates with the vapor vent valve 46 of the fuel tank 18 of FIG. 1, and at least part of a second fluid passage 316*b* may communicate with a fuel vapor canister 320 or some portion of the engine 14 of FIG. 1 such as the carburetor 28. The valve 310 may selectively permit or block communication of the first fluid passage 316*a* with the second fluid passage 316*b* to permit fuel vapor to be vented from the fuel tank 18 and into the fuel vapor canister 320 or the engine 14. A third fluid passage 316*d* is formed in the valve 310 and may communicate with the float valve 94 of the carburetor 28 used in the small engine fuel system 12 of FIG. 1. The third fluid passage 316*d* may be selectively communicated with a fourth fluid passage 316*c* that is communicated with the fuel tank 18 of the fuel system 12 of FIG. 1. The fluid ports 316*a*–316*d* correspond to the fluid ports 48*a*–48*d* of FIG. 1. The valve 310 permits communication between a plurality of passages, and also selectively controls fluid flow through each of the passages by selectively permitting and preventing fluid flow therethrough.

The valve 310 is operable in an open position during operation of the internal combustion engine so as to permit flow of fuel vapors through a vapor passage therein and flow of liquid fuel through a liquid passage therein. The valve 310 is also operable in a closed position when the internal combustion engine is not operating so as to prevent flow of fuel vapors through the vapor passage and flow of liquid fuel through the liquid passage to prevent escape of evaporative emissions from the fuel tank and also to prevent excessive liquid fuel pressure on the float valve 94 when the internal combustion engine is not operating.

Figure 4:
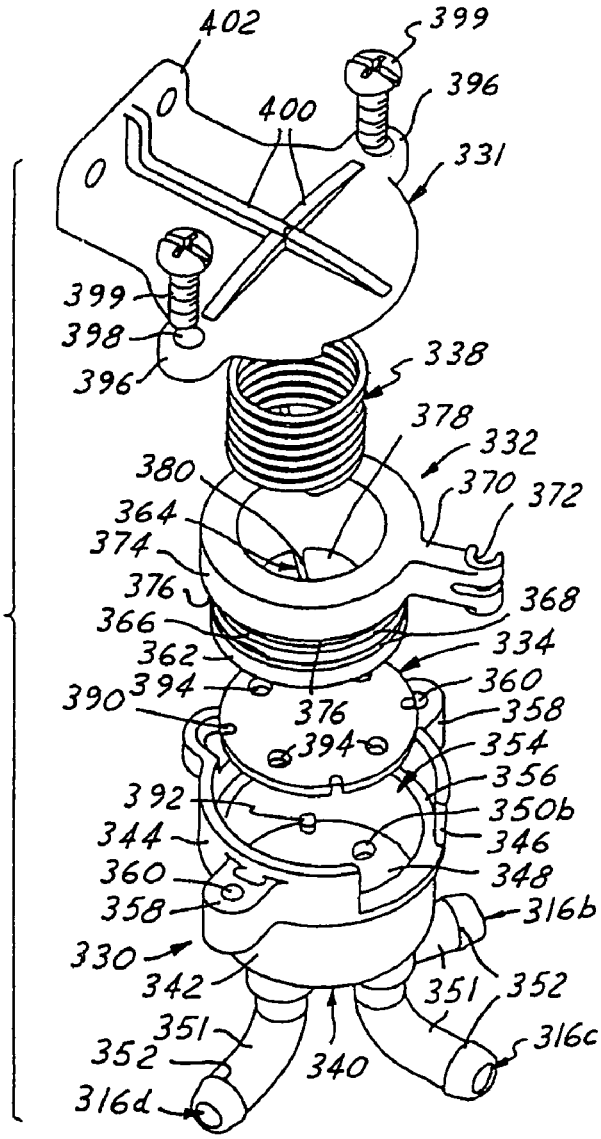
FIG. 4 is a perspective exploded assembly view of the valve of FIG. 3.

Referring to FIG. 4, in one presently preferred embodiment, the valve 310 includes a main valve body 330 including a cover 331, a valve head 332 rotatably received in the body 330 preferably with a gasket 334 between them, and a spring 338 that is preferably disposed between the valve head 332 and cover 331. The valve body 330 includes a generally cylindrical side wall 340 with a circumferentially continuous lower section 342 and an upper section 344 that has a window, opening, or slot 346 therethrough. The side wall 340 is preferably open at one end and substantially closed at its other end by a bottom wall 348 that is preferably generally planar and perpendicular to an axis of the sidewall 340. Preferably, four holes, passages, or ports 350*a–d* (best shown in FIGS. 6–7) are formed in the bottom wall 348 with each port 350*a–d* preferably being formed separately in the valve body 330 and generally equally circumferentially spaced apart. Each port 350*a–d* preferably leads to a separate fluid fitting 351 each of which may be formed with or otherwise carried by the valve body 330. Together, the ports 350*a–d* and the fluid fittings 351 define at least part of the separate fluid passages 316*a–d*. Each fluid fitting 351 preferably includes an outwardly extending barb 352 adapted for press-fit receipt and retention of a fluid conduit thereon. The valve body 330 may include a chamber 354 in which the valve head 332 is rotatably received. The inner diameter of the chamber 354 may be smaller than the inner diameter of the upper section 344 of the side wall 340 providing a radially extending and circumferentially continuous shoulder 356. Radially outwardly extending flanges 358 preferably include openings or holes 360 to facilitate mounting the cover 331 onto the valve body 330.

The valve head 332 preferably includes a generally cylindrical sidewall 362 that is open at one end and is closed at its other end by a bottom wall 364 that is preferably generally planar and perpendicular to an axis of the sidewall 362. Preferably, at least one groove 366 is formed in the outer surface of the sidewall 362 to receive a seal 368, such as an O-ring, to provide a fluid-tight seal between the valve head 332 and the valve body 330. In the presently preferred embodiment, a pair of axially spaced grooves 366 are provided with each groove 366 constructed to receive a separate seal 368. An inner surface 378 of the bottom wall 364 preferably includes a slot 380 or a groove, protrusion, or other means to anchor one end of the spring 338.

An outwardly extending valve lever 370 is carried by the valve head 332, and may be formed integrally therewith. The lever 370 may be attached to or formed integrally with a radially outwardly extending upper section 374 of the valve head 332 that defines a shoulder 376 adapted to be received adjacent to the shoulder 356 of the valve body 330. The lever 370 is adapted to be received in the slot 346 of the valve body 330 to permit limited rotational movement of the valve head 332 relative to the valve body 330. The lever 370 may include a curled or arcuate end 372 to facilitate attachment of the lever 370 to an actuating member, such as a lever, handle or cable that may be used to move the valve head 332 relative to the valve body 330. The valve lever 370 can be actuated to move the valve head 332 between its first and second positions manually, such as by a cable connected to a start lever of the small engine fuel system 12 of FIG. 1 that is actuated to affect other operating characteristics of the fuel system 12 such as to improve the starting characteristics of the engine 14, or by a solenoid or other electrically powered device if electrical power or a battery is available in a particular application.

Figure 5:
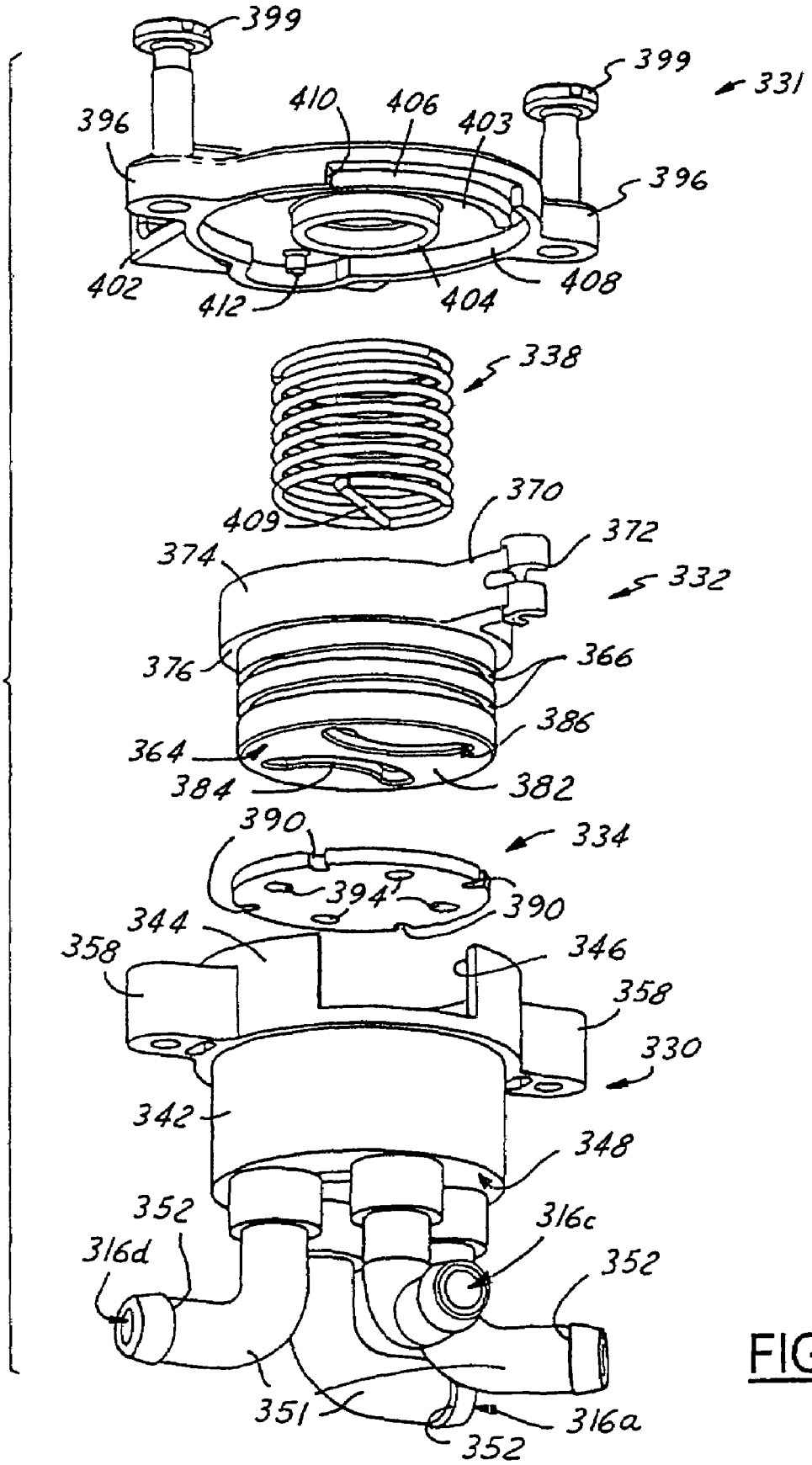
FIG. 5 is another perspective exploded assembly view of the valve of FIG. 3.

As shown in FIGS. 5–7, adjacent to a lower or outer surface 382 of the bottom wall 364 of the valve head 332 has at least one and preferably a pair of connecting passages. In the presently preferred embodiment, two spaced apart grooves 384, 386 define at least part of the connecting passages and are formed each having a size and orientation adapted to selectively communicate a pair of the passages 316*a–d* in the valve body 330 to permit fluid flow between the pair of passages. The grooves 384, 386 preferably are blind grooves that extend axially into but not through the bottom wall 364 of the valve head 332. Any number of grooves can be formed in any size, shape and orientation as desired to communicate any number of passages in and through the valve body 330. In the presently preferred embodiment, the grooves 384, 386 are generally arcuate and are curved or otherwise extend radially inwardly from each end toward the middle of the grooves 384, 386. In this manner, as best shown in FIG. 6, the middle of the grooves 384, 386 are spaced radially inwardly from the radial location of the passages 316*a–d*, and more particularly, from the radial location of the ports 350*a–d* formed in the valve body 330.

Referring to FIGS. 4–5, the gasket 334 is preferably disposed between the outer surface of the bottom wall 364 of the valve head 332 and the inner surface of the bottom wall 348 of the valve body 330. The gasket 334 preferably includes one or more notches 390 formed therein adapted to receive complementary tabs 392 formed in the valve body 330 to locate the gasket 334 and hold it against rotation relative to the valve body 330. The gasket 334 includes a plurality of openings 394 therethrough each of which is aligned with a separate one of the ports 350*a–d* of the passages 316*a–d* in the valve body 330. The gasket 334 is preferably formed of a generally elastomeric material so that it is at least somewhat flexible and resilient to provide a fluid-tight seal between the planar surface 382 of the valve head 332 and the planar surface of the bottom wall 348 of the valve body 330. Representative materials for the gasket 334 include any suitable fuel resistant rubber such as Viton®, or the like.

The cover 331 preferably includes a pair of radially outwardly extending flanges 396 having throughholes 398 adapted to be aligned with the flange holes 360 on the valve body 330 to facilitate mounting the cover 331 onto the valve body 330. The aligned holes 360, 398 may receive threaded fasteners 399, such as bolts, or screws which may be self tapping screws to facilitate assembly of the cover 331 onto the valve body 330. Of course, other fasteners could be used and the cover 331 can be permanently or removably mounted to the valve body 330 such as by welding, bonding with an adhesive, heat staking, snap-fit, or by use of an appropriate fastener. The cover 331 may include one or more upstanding ribs 400 to increase its rigidity and preferably includes a mounting bracket 402 that may be integrally formed or otherwise carried by the cover 331 or the body 330.

As best shown in FIG. 5, an inner surface 403 of the cover 331 preferably includes a depending annular skirt 404, and a depending arcuate wall 406 spaced radially outwardly from the skirt 404 and radially inwardly from a depending peripheral flange 408. The depending peripheral flange 408 is adapted to be engaged with the upper surface of the valve body 330 in assembly. The peripheral flange 408 includes a slot or recess 410 formed therein that is preferably aligned with the slot 346 in the valve body 330 and defines part of the area in which the lever 370 of the valve head 332 moves relative to the valve body 330 and cover 331. Although not shown, it is preferable to include a foam or rubber seal between the arcuate wall 406 and the flange 408 to prevent dust or dirt from entering the apparatus. The seal may be composed any type of fuel resistant material such as Viton®, or the like.

The spring 338 is preferably disposed between the valve head 332 and the cover 331. The spring 338 is preferably a compression and torsional coil spring. In assembly, the spring 338 is compressed between the cover 331 and the valve head 332 to provide an axial compressive force to bias the valve head 332 onto the gasket 334 to improve the seal between them as well as between the gasket 334 and valve body 330. In the presently preferred embodiment, the spring 338 also yieldably and torsionally biases the valve head 332 toward a first position relative to the valve body 330. One end 409 of the spring 338 may be bent so that it may be received in the groove 380 formed in the bottom wall 364 of the valve head 332. The other end of the spring 338 is preferably disposed in contact with a depending post 412 provided on the cover 331.

In the presently preferred embodiment, as shown in FIG. 6, to prevent communication between any of the passages, the valve head 332 may be disposed in a first position relative to the valve body 330 wherein both of the grooves 384, 386 are spaced from and not registered or aligned with any of the ports 350*a–d* of the passages 316*a–d* in the valve body 330. As shown in FIG. 7, when the valve head 332 is moved to its second position, the first groove 384 is aligned with the ports 350*a*, 350*b* of both the first and second passages 316*a*, 316*b* to communicate these passages with each other and permit fluid flow between them. The second groove 386 is aligned with the ports 350*c*, 350*d* of both the third and fourth passages 316*c*, 316*d* to communicate these passages with each other and permit fluid flow between them.

By way of example, without limitation, the first passage 316*a* may communicate with the fuel tank vent valve 46 and the second passage 316*b* may communicate with the fuel vapor canister 320 or the inlet end 74 of the carburetor 28 of FIG. 1. Accordingly, when the valve head 332 is in its first position, the fuel tank vent valve 46 is not communicated with the fuel vapor canister 320 or carburetor 28, thereby preventing the flow of fuel vapor from the fuel tank 18 to the fuel vapor canister 320 or carburetor 28. When the valve head 332 is in its second position, the fuel tank vent valve 46 is communicated with the fuel vapor canister 320 or carburetor 28 so that fuel vapor can flow from the fuel tank 18, through the vent valve 46 and into the fuel vapor canister 320 or carburetor 28.

The third passage 316*c* may be communicated with the fuel tank 18 of FIG. 1 such as the liquid fuel outlet 33 thereof, and the fourth passage 316*d* may be communicated with the engine 14 of FIG. 1 by way of the float valve 94 and float bowl 86 of the carburetor 28, for example. When the valve head 332 is in its first position, fluid flow through the valve 310 and between the fuel tank 18 and the float valve 94 is not permitted. And when the valve head 332 is in its second position, the fuel tank 18 is communicated with the float valve 94 through the valve 310 to permit, for example, liquid fuel to flow into the carburetor 28 from the fuel tank 18 when the float valve 94 is open. The present invention, however, contemplates that the valve 310 could be used to communicate any fuel system outputs, such as vapor vents of fuel tanks or carburetors, fuel filters, and the like, with any fuel system or engine inputs, such as carbon canisters, carburetor mixing passages, carburetor float valves, engine intakes, and the like.

The valve 310 is preferably operable to sequentially permit the fuel tank to vent fuel vapors before permitting the fuel tank to communicate the liquid fuel to the carburetor, thereby preventing high pressure on a carburetor fuel chamber inlet needle valve. The converse also applies, wherein the valve 310 is preferably operable to sequentially prevent the fuel tank from communicating the liquid fuel to the carburetor, before preventing the fuel tank to vent fuel vapors. This sequential operation may be carried out by clocking, or angularly adjusting, the location of the vapor vent passages relative to the liquid fuel supply passages so that the vapor vent passages are opened before the liquid fuel supply passages as the valve head 332 is rotated.

Figure 8:
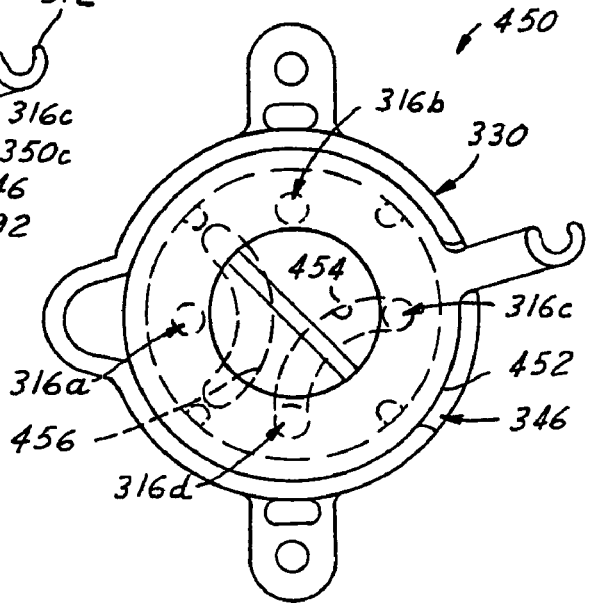
FIG. 8 is a somewhat diagrammatic plan view of an alternate embodiment of a valve according to the present invention illustrating a valve head in one position.
Figure 9:
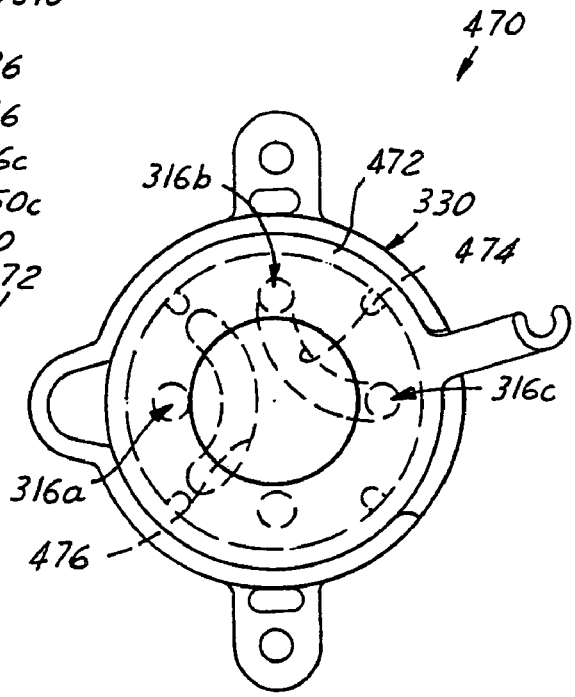
FIG. 9 is a somewhat diagrammatic plan view of another alternate embodiment of a valve according to the present invention illustrating a valve head in one position.

FIGS. 8 and 9 illustrate two alternate embodiments of valves 450, 470 including different valve head arrangements. While both of the embodiments in FIGS. 8 and 9 include a pair of grooves 454, 456 and 474, 476 and four passages 316*a*–316*d* formed in the valve body 330, the number, location and size of the passages in the valve body 330 and the corresponding grooves in the valve head 332 can be varied as desired. For similar parts or components, the same reference numbers used for the first embodiment valve 310 are also applied to the valves shown in FIGS. 8 and 9.

In FIG. 8, the valve 450 includes a valve head 452, which is shown in a first position wherein a first groove 454 in the valve head 452 communicates the third and fourth passages 316*c*, 316*d* in the valve body 330. A second groove 456 in the valve head 452 is spaced from both the first and second passages 316*a*, 316*b* so that there is no flow between the first and second passages 316*a*, 316*b*. When the valve head 452 is rotated to its second position (not shown) the first groove 454 is rotated out of registry or alignment with the third and fourth passages 316*c*, 316*d* so that the third and fourth passages 316*c*, 316*d* do not communicate with each other. The second groove 456 is rotated into registry or alignment with the first and second passages 316*a*, 316*b* providing fluid communication between them.

In FIG. 9, the valve 470 has a valve head 472, which is shown in a first position wherein a first groove 474 communicates the second and third passages 316*b*, 316*c* formed in the valve body 330. In this first position, a second groove 476 is not aligned or communicated with any of the passages in the valve body 330. When the valve head 472 is rotated to its second position (not shown) the first groove 474 is rotated out of registry or alignment with any passage, thereby preventing fluid flow in the groove 474, and the second groove 476 is registered with the first and second passages 316*a*, 316*b* providing fluid communication between them. Accordingly, as shown, FIG. 9 uses only three of the passages 316*a*, 316*b*, and 316*c* in the valve 470 and selectively communicates the second passage 316*b* with the first and third passages 316*a*, 316*c*, respectively, in the different positions of the valve head 472.

The valves 310, 450, 470 described herein are of relatively simple design and construction and can be manufactured and assembled relatively inexpensively. The valves 310, 450, 470 are readily adaptable to a wide variety of fuel systems to control fluid flow in the fuel system including, without limitation, the venting or routing of fuel, air, fuel vapor and fuel and air mixtures in the fuel storage and delivery systems.

Among other things, the fuel system of the present invention limits the quantity of fuel vapor losses to the atmosphere during equipment storage, and does not necessarily require use of a carbon canister to do so. As defined herein, the term atmosphere is broadly construed to include not only the gaseous mass surrounding the earth but also any vessel, chamber, or the like, which may be open or fluidically communicated to the atmosphere. In developing certain embodiments of the present invention, it was discovered that one way to reduce fuel vapor losses from a fuel tank is to change the conventional fuel tank venting scheme from bi-directional venting to uni-directional venting. When the engine is not operating, such uni-directional venting does not allow the fuel tank to vent out to the atmosphere, yet allows free venting of the atmosphere into the fuel tank to preclude any negative pressure conditions within the fuel tank. During operation of the engine, the fuel tank venting scheme of the present invention employs bi-directional venting, thereby eliminating the need for any changes to the carburetor or the addition of a fuel pump.

In conclusion, the method, fuel system, and components of the presently preferred embodiments of the present invention enable a reduction in the quantity of unburned fuel vapor losses to the atmosphere during equipment shutdown and storage, without necessarily requiring a carbon canister vapor recovery system. In prior art systems, a fuel tank is bi-directionally vented to permit vapors to escape during storage and thereby prevent pressure build up within the fuel tank. In some prior art systems, a fuel tank is uni-directionally vented to prevent vapors to escape during storage. Undesirably, however, pressure builds up, such as within the tank, and tends to overwhelm the float valve of the carburetor, thereby flooding the carburetor and creating evaporative emissions. In other prior art systems, a bi-directional vent on the fuel tank is connected to a carbon canister to temporarily capture the vapors, thereby preventing the vapors from escaping to the atmosphere. Carbon canisters, however, can be undesirable in at least some applications for a number of reasons.

The fuel system according to a presently preferred embodiment of the present invention uses a tank vent valve having fuel check valves, and also uses a manually actuated dual-passage valve to close the fuel tank vapor vent line and the fuel tank liquid fuel line on engine shutdown and storage and, conversely, open the fuel tank vapor vent line and the fuel tank liquid fuel lines upon engine startup and during engine operation. Alternatively, the dual-passage valve may be operable to sequentially open and close the various passages to permit venting of tank vapors before the fuel tank communicates the liquid fuel to the carburetor to prevent high pressure on a carburetor fuel chamber inlet needle valve. During storage, the tank is not permitted to vent fuel vapors to the atmosphere thereby preventing evaporative emissions from the tank during storage, although permitting pressure to build up within the fuel tank. Such built up liquid fuel pressure, however, is cutoff from the carburetor by the closed dual-passage valve during storage. Upon start up of the engine, the built up fuel vapor pressure is advantageously permitted to vent or bleed into the carburetor for eventual combustion in the engine. Preferably, the tank pressure is relieved by venting fuel vapor through the dual-passage valve and strategically introducing the vapors upstream of the carburetor choke valve. During operation, no pressure builds up within the fuel tank by virtue of the open vapor vent passage. Rather, the vapors are consumed in the combustion process of the engine by entering the fresh air intake stream of the carburetor.

While certain preferred embodiments have been shown and described, ordinarily skilled persons will readily recognize that the preceding description has been set forth in terms of description rather than limitation, and that various modifications and substitutions can be made without departing from the spirit and scope of the invention. For example, without limitation, the number, size, shape and orientation of the fluid passages formed in the valve can be varied as desired for various applications. Also, while the grooves 384, 386, 454, 456, 474, 476 have been shown as bridging or communicating two fluid passages when aligned therewith, the grooves and passages can be constructed such that each groove selectively permits fluid communication between more than two passages. Of course, still other modifications or substitutions can be made within the spirit and scope of the invention. The invention is defined by the following claims.

What is claimed is:

1. A method of delivering fuel from a fuel tank in fluid communication with a carburetor of an internal combustion engine, the method comprising the steps of:

containing the fuel within the fuel tank, the fuel including liquid fuel and fuel vapors;

during operation of the internal combustion engine, permitting the fuel tank to fluidically communicate the liquid fuel to the carburetor, and to vent the fuel vapors;

during inoperation of the internal combustion engine, preventing the fuel tank from fluidically communicating the liquid fuel to the carburetor, and from venting the fuel vapors, thereby preventing escape of evaporative emissions of the fuel from the fuel tank; and wherein the permitting and preventing steps are carried out by a single valve.

2. The method of claim 1 wherein the during operation step includes permitting the fuel tank to fluidically communicate the liquid fuel to the carburetor and to vent the fuel vapors to at least one of a carbon canister, the atmosphere, engine air intake, engine air cleaner, and the carburetor, and further wherein the during inoperation step includes preventing the fuel tank from venting the fuel vapors to at least one of a carbon canister, the atmosphere, engine air intake, engine air cleaner, or the carburetor.

3. The method of claim 1 wherein the permitting step includes permitting the fuel tank to vent the fuel vapors into a mixing passage of the carburetor.

4. The method of claim 3 wherein the permitting step includes permitting the fuel tank to vent the fuel vapors into the mixing passage and upstream of a venturi section of the mixing passage.

5. The method of claim 4 wherein the permitting step includes permitting the fuel tank to vent the fuel vapors into the mixing passage and upstream of a choke valve in the mixing passage.

6. The method of claim 5 wherein the permitting step includes permitting the fuel tank to vent the fuel vapors into the mixing passage and upstream of an air filter in the mixing passage.

7. The method of claim 6 wherein the permitting step includes permitting the fuel tank to vent the fuel vapors into a noise suppression chamber of the mixing passage.

8. The method of claim 1 further comprising the step of manually actuating the valve.

9. The method of claim 8 wherein the manually actuating step is carried out by a push-pull cable connected to the valve and connected to an ignition control device.

10. A method of delivering fuel from a fuel tank in fluid communication with a carburetor of an internal combustion engine, the method comprising the steps of:

containing the fuel within the fuel tank, the fuel including liquid fuel and fuel vapors;

during operation of the internal combustion engine, permitting the fuel tank to fluidically communicate the liquid fuel to the carburetor, and to vent the fuel vapors;

during inoperation of the internal combustion engine, preventing the fuel tank from fluidically communicating the liquid fuel to the carburetor, and from venting the fuel vapors, thereby preventing escape of evaporative emissions of the fuel from the fuel tank; and the permitting step is sequenced so that the fuel tank vents the fuel vapors before the fuel tank communicates the liquid fuel to the carburetor to prevent high pressure on a carburetor fuel chamber inlet needle valve.

11. A fuel system for an internal combustion engine having a float-bowl carburetor, the fuel system comprising:

a fuel tank for containing a supply of liquid fuel and fuel vapors, the fuel tank having a liquid fuel outlet and a fuel vapor outlet port;

a vapor vent valve mounted to a portion of the fuel tank in fluid communication with the fuel vapor outlet port, the vapor vent valve preventing the liquid fuel from exiting the fuel tank through the fuel vapor outlet port, and permitting the fuel vapors to exit the fuel tank through the fuel vapor outlet port;

a liquid conduit having a downstream end, and an upstream end in fluid communication with the liquid fuel outlet of the fuel tank;

a vapor conduit having a downstream end, and an upstream end in fluid communication with the vapor vent valve;

a valve having a vapor passage including a vapor outlet and also including a vapor inlet in fluid communication with the downstream end of the vapor conduit, the valve further having a liquid passage including a liquid outlet and also including a liquid inlet in communication with the downstream end of the liquid conduit;

a second vapor conduit having an upstream end in fluid communication with the vapor outlet of the valve and further having a downstream end in fluid communication with at least one of a carbon canister, the atmosphere, or an intake passage of the engine;

a second liquid conduit having an upstream end in fluid communication with the liquid outlet of the valve and further having a downstream end in fluid communication with the carburetor;

the valve being operable in an open position during operation of the internal combustion engine so as to permit flow of the fuel vapors through the vapor passage and flow of the liquid fuel through the liquid passage, the valve being operable in a closed position when the internal combustion engine is not operating so as to prevent flow of the fuel vapors through the vapor passage and flow of the liquid fuel through the liquid passage to prevent escape of evaporative emissions from the fuel tank when the internal combustion engine is not operating.

12. The fuel system of claim 11 wherein the carburetor includes a mixing passage that is in fluidic communication with the intake passage of the engine and the downstream end of the second vapor conduit is in fluidic communication with the mixing passage.

13. The fuel system of claim 12 wherein the mixing passage includes a venturi section and the downstream end of the second vapor conduit fluidically communicates with the mixing passage upstream of the venturi section.

14. The fuel system of claim 13 wherein the mixing passage further includes a choke valve therein and the downstream end of the second vapor conduit fluidically communicates with the mixing passage upstream of the choke valve.

15. The fuel system of claim 14 wherein the mixing passage includes an air filter therein and the downstream end of the second vapor conduit fluidically communicates with the mixing passage upstream of the air filter.

16. The fuel system of claim 15 wherein the mixing passage includes a noise suppression chamber and the downstream end of the second vapor conduit fluidically communicates with the mixing passage in the noise suppression chamber.

17. The fuel system of claim 11 wherein the valve is a manually actuated device.

18. The fuel system of claim 17 wherein the fuel system is adapted for use with an engine-powered ground-supported apparatus having an ignition control device, and further wherein the valve is manually actuated by a push-pull cable attached connected to the valve and connected to the ignition control device.

19. The fuel system of claim 11 wherein the valve is operable for sequentially permitting the fuel tank to vent the fuel vapors before the fuel tank communicates the liquid fuel to the carburetor to prevent high pressure on a carburetor fuel chamber inlet needle valve.

20. The fuel system of claim 11 where the vapor vent valve includes a main passage in fluid communication with the fuel tank and an outlet passage in fluid communication with the main passage, the vapor vent valve further includes a liquid check valve in fluid communication with the main passage for preventing liquid fuel from exiting the fuel tank and a vapor check valve in fluid communication with the main passage for permitting atmospheric vapors into the fuel tank and for preventing fuel vapors from exiting the fuel tank through the vapor vent valve.

21. A fuel system for an internal combustion engine having a float-bowl carburetor, the fuel system comprising:

a fuel tank for containing a supply of liquid fuel and fuel vapors, the fuel tank having a liquid fuel outlet and a fuel vapor outlet port;

a vapor vent valve mounted to a portion of the fuel tank in fluid communication with the fuel vapor outlet port, the vapor vent valve preventing the liquid fuel from exiting the fuel tank through the fuel vapor outlet port, and permitting the fuel vapors to exit the fuel tank through the fuel vapor outlet port;

a liquid conduit having a downstream end, and an upstream end in fluid communication with the liquid fuel outlet of the fuel tank;

a vapor conduit having a downstream end, and an upstream end in fluid communication with the vapor vent valve;

a valve for controlling fluid flow, the valve including:

a valve body having at least three fluid passages formed therein;

a valve head carried by the valve body for movement between at least first and second positions and having at least two connecting passages formed therein, each connecting passage being selectively registrable with at least two fluid passages to permit fluid communication between the at least two fluid passages through the connecting passage;

a second vapor conduit having an upstream end in fluid communication with the vapor outlet of the valve and further having a downstream end that fluidically communicates to at least one of a carbon canister, the atmosphere, or an intake passage of the engine;

a second liquid conduit having an upstream end in fluid communication with the liquid fuel outlet of the valve and further having a downstream end in fluid communication with the carburetor;

the valve being operable in an open position during operation of the internal combustion engine so as to permit flow of the fuel vapors through the vapor passage and flow of the liquid fuel through the liquid passage, the valve being operable in a closed position when the internal combustion engine is not operating so as to prevent flow of the fuel vapors through the vapor passage and flow of the liquid fuel through the liquid passage to prevent escape of evaporative emissions from the fuel tank when the internal combustion engine is not operating.

22. The system of claim 21 wherein the valve body has a bottom wall in which each fluid passage is at least partially defined, and the valve head includes a bottom wall communicating with each of the fluid passages with the connecting passages formed in the bottom wall of the valve head.

23. The system of claim 22 wherein the connecting passages are defined at least in part by grooves formed in the valve head.

24. The system of claim 23 wherein the grooves are blind grooves formed in the bottom wall of the valve head.

25. The system of claim 22 wherein the bottom wall of the valve body has a generally planar inner surface and the bottom wall of the valve head has a generally planar outer surface adapted to be received adjacent to the inner surface of the valve body bottom wall.

26. The system of claim 25 which also includes a gasket disposed between the bottom wall of the valve head and the bottom wall of the valve body and including at least one opening for each of the fluid passages to permit fluid flow through the fluid passages and the gasket.

27. The system of claim 21 which also includes a biasing member associated with the valve head to yieldably rotatably bias the valve head toward its first position.

28. The system of claim 21 which also includes a biasing member associated with the valve head to bias the valve head toward the valve body.

29. The system of claim 21 wherein the valve body defines a chamber to receive the valve head with at least one seal being disposed in the chamber between the valve head and the valve body to prevent fluid leakage between them.

30. The system of claim 21 wherein the valve body includes an opening and the valve head includes a lever received through the opening in the valve body, the valve lever being carried by the valve head so that movement of the valve lever moves the valve head relative to the valve body.

31. The system of claim 21 wherein the at least three fluid passages include at least first, second and third fluid passages and when the valve head is in its first position one of the connecting passages is communicated with the first and second fluid passages, and when the valve head is in its second position the other connecting passage is communicated with the second and third fluid passages.

32. The system of claim 21 wherein the at least three fluid passages include at least first, second, third and fourth fluid passages and when the valve head is in its first position one of the connecting passages is communicated with the first and second fluid passages, and when the valve head is in its second position the other connecting passage is communicated with the third and fourth fluid passages.

33. The system of claim 32 wherein when the valve head is in its first position the other connecting passage is not communicated with the third and fourth fluid passages, and when the valve head is in its second position the one of the connecting passages is not communicated with the first and second fluid passages.

34. The system of claim 21 wherein the at least three fluid passages includes at least four fluid passages and when the valve head is in its first position the connecting passages are not communicated with any of the fluid passages, and when the valve head is in its second position one connecting passage is communicated with two of the fluid passages and the other connecting passage is communicated with two other fluid passages.

35. A fuel system for an internal combustion engine having a carburetor, the fuel system comprising:

a fuel tank for containing a supply of liquid fuel and fuel vapors, the fuel tank having a liquid fuel outlet and a separate fuel vapor outlet;

a valve movable to an open position and a closed position and having a fuel inlet configured to communicate with the tank liquid fuel outlet, a fuel outlet configured to communicate with the carburetor, a separate vapor inlet configured to communicate with the tank vapor outlet and a vapor outlet configured to communicate with at least one of a carbon canister, the atmosphere, an engine air intake, an engine air cleaner, or a mixing passage of the carburetor, and in the open position the fuel inlet communicates with the fuel outlet and the vapor inlet communicates with the vapor outlet, and in the closed position, the fuel inlet does not communicate with the fuel outlet to thereby retain liquid fuel in the fuel tank and the vapor inlet does not communicate with the vapor outlet to thereby retain fuel vapor in the tank; and when the engine is operating, the valve is in the open position to permit flow of liquid fuel to the carburetor and fuel vapor to at least one of the carbon canister, atmosphere, engine air intake, engine air cleaner or mixing passage of the carburetor, and when the engine is not operating, the valve is in the closed position to prevent the flow of liquid fuel from the tank to the carburetor and the flow of fuel vapor from the fuel tank.

36. The method of claim 1 wherein the valve has a valve body with at least three fluid passages formed therein; and a valve head carried by the valve body for movement between at least the first and second positions and having at least two separate connecting passages formed therein, each connecting passage being selectively registrable with at least two of the fluid passages to permit fluid communication between the at least two fluid passages through the connecting passage.

37. The method of claim 36 wherein the valve body has a first wall in which each passage is at least partially defined and the valve head has a complementary second wall with the connecting passages formed in the second wall of the valve head.

38. The method of claim 36 wherein when the valve head is in the first position, the connecting passages do not communicate any of the inlets with any of the outlets and when the valve head is in the second position, one of the connecting passages communicates the fuel inlet with the fuel outlet and the other connecting passage communicates the vapor inlet with the vapor outlet.

39. The fuel system of claim 35 wherein the valve has a valve body with at least three fluid passages formed therein; and a valve head carried by the body for movement between at least the first and second positions and having at least two separate connecting passages formed therein, each connecting passage being selectively registrable with at least two of the fluid passages to permit fluid communication.

40. The fuel system of claim 36 wherein the valve body has a first wall in which each passage is at least partially defined and the valve head has a complementary second wall with the connecting passages fanned in the second wall of the valve head.

41. The fuel system of claim 36 wherein when the valve head is in the first position, the connecting passages do not commumcate any of the inlets with any of the outlets and when the valve head is in the second position, one of the connecting passages communicates the fuel inlet with the fuel outlet and the other connecting passage communicates the vapor inlet with the vapor outlet.

* * * * *

UNITED STATES PATENT AND TRADEMARK OFFICE

CERTIFICATE OF CORRECTION

PATENT NO. : 7,185,639 B1
APPLICATION NO. : 10/955795
DATED : March 6, 2007
INVENTOR(S) : Ronald H. Roche et al.

It is certified that error appears in the above-identified patent and that said Letters Patent is hereby corrected as shown below:

Column 16
Line 10, delete “attached”.

Column 19
Line 2, delete “fanned” and insert -- formed -- .

Column 19
Line 6, delete “commumcate” and insert -- communicate --.

Signed and Sealed this

Twenty-ninth Day of May, 2007

JON W. DUDAS
*Director of the United States Patent and Trademark Office*